US006874558B2

(12) United States Patent
Mester et al.

(10) Patent No.: US 6,874,558 B2
(45) Date of Patent: Apr. 5, 2005

(54) AWNING WITH INCLINATION ADJUSTMENT

(75) Inventors: Reiner Mester, Lennestadt (DE); Wolfgang Voss, Attendorn (DE)

(73) Assignee: Paul Voss GmbH & Co. KG, Finnentrop-Heggen (DE)

( * ) Notice: Subject to any disclaimer, the term of this patent is extended or adjusted under 35 U.S.C. 154(b) by 0 days.

(21) Appl. No.: 10/408,212

(22) Filed: Apr. 4, 2003

(65) Prior Publication Data

US 2004/0016511 A1 Jan. 29, 2004

Related U.S. Application Data

(63) Continuation of application No. PCT/EP01/10091, filed on Sep. 1, 2001.

(30) Foreign Application Priority Data

Oct. 6, 2000 (DE) ..... 200 17 320 U

(51) Int. Cl.[7] ..... E04F 10/06
(52) U.S. Cl. ..... 160/22; 160/66
(58) Field of Search ..... 160/22, 66, 67; 135/88.11; 248/273, 269, 270, 271, 272

(56) References Cited

U.S. PATENT DOCUMENTS

| | | | | |
|---|---|---|---|---|
| 1,871,957 A | | 8/1932 | Chryst | |
| 3,782,443 A | * | 1/1974 | Clauss et al. | 160/22 |
| 4,566,516 A | * | 1/1986 | Lohausen | 160/22 |
| 4,673,017 A | * | 6/1987 | Lauzier | 160/22 |
| 5,029,363 A | | 7/1991 | Hesener | |
| 5,133,397 A | * | 7/1992 | Lohausen | 160/22 |
| 5,394,921 A | * | 3/1995 | Lohausen | 160/22 |

FOREIGN PATENT DOCUMENTS

| | | |
|---|---|---|
| DE | G 87 09 415 | 11/1987 |
| DE | 89 07 928.0 | 12/1990 |
| DE | 196 18 460 A | 11/1997 |
| EP | 0 397 906 A | 11/1990 |
| EP | 0 593 389 | 4/1994 |
| NL | 900 2439 A | 6/1992 |

* cited by examiner

*Primary Examiner*—David Purol
(74) *Attorney, Agent, or Firm*—Knobbe, Martens, Olson & Bear, LLP

(57) ABSTRACT

An awning including a canvas shaft, a canvas wounded onto the canvas shaft, and a sleeve enclosing the canvas shaft. A stationary support means carries the sleeve. An arrangement for adjusting an inclination of the sleeve by rotation contains one lateral sleeve carrier which is connected to a respective lateral holder and which can be rotated relative to the holder about the awning-canvas-shaft axis. An actuating element, which can be moved serves for adjusting the inclination of the sleeve.

14 Claims, 6 Drawing Sheets

AWNING WITH INCLINATION ADJUSTMENT

RELATED APPLICATIONS

This application is a continuation of pending International Application PCT/EP01/10091 filed on Sep. 1, 2001 which designates the U.S. and which claims priority from German Utility Model Application 200 17 320.0 filed Oct. 6, 2000 both of which applications are incorporated herein in their entireties by reference.

BACKGROUND OF THE INVENTION

1. Field of the Invention

The invention relates to an awning having a sleeve which encloses an awning-canvas shaft, in which the awning canvas can be retracted and extended through a slit-like opening in the sleeve, having stationary support means for the sleeve, the lateral holders thereof retaining the sleeve, and having an arrangement for adjusting the inclination of the sleeve by rotation of the same about the awning-canvas-shaft axis.

2. Description of the Related Art

In the case of such known awnings, the awning-canvas shaft is encased by a sleeve which encloses it. With the awning retracted, the awning canvas is thus protected against external environmental influences.

The awning canvas is extended and retracted again through the slit-like opening.

It is often desirable for the awning canvas to be extended out of the sleeve not horizontally but usually in a downwardly inclined manner in the direction of gravitational force, for example, at an angle of inclination of 30°, 40°, 50° or more, depending on the customer's wishes.

Since the slit-like opening in the sleeve has to be kept as narrow as possible, the awning canvas would brush along an edge of the slit opening. If the slit opening were oriented, for example, such that the awning canvas, when extended horizontally, could extend out of the slit in a contact-free manner, the awning canvas would brush along the bottom slit end in the case of it being inclined. Furthermore, it would not be possible for the opening-out rod at the opening-out end of the awning canvas to be advanced right up to the slit opening.

Provision is thus made for the sleeve to be configured such that it can be rotated about the awning-canvas-shaft axis, with the result that the slit-like opening can be oriented in accordance with the desired angle of inclination.

In the case of a known design, this adjustability is achieved such that two diametrically opposite stay bolts project axially laterally from the sleeve, it being possible for said stay bolts to be displaced in corresponding circumferential slots in the lateral holder which extends over a certain circumferential angle. In the desired rotary position, the stay bolts are then secured by clamping via lock nuts which can be screwed in the axial direction from the outside. The adjusting angles here extend approximately up to 55°.

The installation procedure is such that, once the awning has been installed, these lock nuts are released and the sleeve is rotated, in accordance with the customer's wishes, into the desired extension inclination of the awning canvas, and the lock nuts are then screwed tight again.

The disadvantage with this securing principle, is that, over the long term, the sleeve can rotate relative to the holder. When awnings are extended, gusts of wind subject them to considerable forces which, despite the adjusting screws being firmly tightened, may result in the inclination being adjusted. In particular, in the case of very wide awnings which can be extended to a very great extent, the extended awning-canvas surface provides a considerable surface area on which such forces can act.

A further disadvantage is that all the components of an awning are usually coated with materials which have a very smooth surface. This is carried out not just for the sake of the visual appearance, but also so that the awnings exposed to the environmental influences do not gradually become soiled in an unsightly manner as a result of dirt adhering to rough surfaces. These smooth surfaces aid rotation of the sleeve when the awning is blown upwards by gusts of wind.

If the customer changes his/her mind in respect of the inclination setting, it is necessary, in order for it to be possible to carry out the manipulations which are necessary in the axial direction, to remove lateral end caps in order to gain access correspondingly.

If the awning extends over the entire width of a balcony projecting from a wall of a building, it is thus necessary to carry out manipulations which involve reaching laterally beyond the balcony, which constitutes a risk for the person carrying out the manipulations and should thus not be carried out by the customer himself/herself.

Approaches to the solution have been sought to the effect of configuring the adjusting arrangement such that, as seen from the radial direction, correspondingly directed manipulations are possible for adjusting purposes.

It is then necessary, however, to provide corresponding mechanisms which convert these manipulations into rotary movements of the sleeve.

However, it is an aim for cassette awnings and sleeve awnings to be designed to be as narrow as possible and with as little bulk as possible, that is to say, to depart from the large-volume box awnings and ultimately to provide a structure which is determined essentially by the outer contour of the narrow sleeve, or, in the case of cassette awnings, by the contour of the cassette which additionally covers the arms, this usually being carried out by the opening-out profile of the opening-out rod.

It is the object of the present invention to provide an awning, with an arrangement for adjusting the inclination of the sleeve, which allows straightforward and permanently remaining adjustment of the inclination and is not bulky.

SUMMARY OF THE INVENTION

The object is achieved according to the invention in that the arrangement has in each case one lateral sleeve carrier which is connected to the respective lateral holder and can be rotated relative to the holder about the awning-canvas-shaft axis, in that the sleeve carrier contains a slot opening which extends in the tangential direction in relation to an imaginary turning circle and in which a sliding block runs, in that there is provided an actuating element which can be moved rectilinearly in the direction of the slot opening and is supported, on the one hand, on the sleeve carrier and, on the other hand, on the sliding block, and in that the sliding block, furthermore, extends in a further slot opening, extending radially in relation to the awning-canvas-shaft axis, in the stationary holder and is supported therein.

These measures, then, have a number of considerable advantages.

An actuating element which moves tangentially in relation to an imaginary turning circle can be actuated by an operator standing in front of the awning; that is to say there is no longer any need for manipulations extending laterally beyond the awning.

A sliding block which moves along a tangent is spaced apart, depending on the displacement along the tangent, to a more or less great extent from the center point of said imaginary turning circle, that is to say is at a variable spacing from the axis of rotation of the awning-canvas shaft. This radial movability, then, is provided by the stationary holder containing corresponding radially extending slot openings in which the sliding block is supported.

This basic principle, then, makes it possible, by rectilinear adjustment of the actuating element, to allow rotation of the sleeve carrier relative to the stationary holder by the sliding block being displaced rectilinearly along the slot opening by the actuating element. This linear movement is converted into a rotary movement of the sleeve in that the sliding block is supported on the stationary holder. The necessary radial movability, that is to say, the change in the radial spacing of the sliding block from the axis of rotation is made possible, at the same time, in that this opening is designed as a radial slot opening in the stationary holder. The interaction of these basic components provides an extremely compact adjusting arrangement which is convenient to operate and does not detract from the outer appearance of the narrow awning. At the same time, the actuating element, which rests on the sliding block, blocks the sleeve carrier against further inclination, with the result that even very heavy awnings which extend to a great extent are reliably retained in the inclined position.

In a further configuration of the invention, provision is made for two mutually opposite arrangements of this type, with their sliding blocks running in opposite directions, to be formed in relation to the awning-canvas-shaft axis.

This measure, then, has the advantage that, in addition to the inclination adjustment, it is also possible, at the same time, using the same components, to inhibit the awning from blowing upward.

The sliding block, which can be displaced in the tangential slot opening, has the actuating element acting on it, and adjusting it, from one side. This means that it could move away from the actuating element in the opposite direction, for example, if, with the awning canvas extended, the latter is forced upward. In other words, the actuating element rests on the sliding block with support in the direction of gravitational force.

Providing the second, approximately diametrically opposite arrangement of the same design, then, makes it possible to achieve an additional means for inhibiting the awning from blowing upward. Since this arrangement is located diametrically opposite, its actuating element, which can be adjusted rectilinearly from the same side as the other actuating element, blocks the sliding block of the second arrangement, this sliding block running in the opposite direction to the first sliding block, in the direction which is left free by the other actuating element.

In other words, one arrangement serves for adjusting the inclination, while the actuating element of the other arrangement blocks the awning from being blown upward in the opposite direction.

Basically just one of these arrangements can adjust the inclination; the other secures the awning against being blown upward.

The two arrangements are nevertheless of substantially identical design, but are arranged on two opposite sides of the axis of rotation.

Opposite does not mean that these have to be located exactly diametrically opposite one another, nor does it mean that the two slot openings have to extend parallel; rather it is also possible for the tangents to form the legs of a V.

In a further configuration of the invention, the actuating element is designed as a screw which runs in a thread formed in the sleeve carrier.

This measure has the advantage that a stable actuating element which is easy to handle is provided by means of a screw. The necessary opposing force in relation to the movable sliding block is absorbed by the thread. These components can easily be accommodated in the sleeve carrier since the latter is of approximately the same dimensions, in any case, as the diameter of the sleeve. This thread may be cut into the body of the sleeve carrier, with the result that there is no need for any laterally projecting structural means.

In a further configuration of the invention, the sliding block has a securing arrangement via which the sleeve carrier and the lateral holder can be clamped to one another.

This measure, then, has the advantage that, in the desired inclined position of the sleeve, the position of the sliding block is secured and thus, at the same time, the sleeve carrier and lateral holder are clamped to one another.

This configuration may be selected both when just one arrangement is provided, in which case this also acts as a means for inhibiting the awning from blowing upward, and when the two diametrically opposite guide means are provided, in which case, this configuration serves as an additional securing arrangement.

In a further configuration of the invention, the securing arrangement has an adjusting screw which is accommodated in a thread in the sliding block.

This measure has the advantage that the sliding block can be secured by a structurally straightforward means.

In a further configuration of the invention, a head of the adjusting screw and the sliding block each rest on shoulders in the slots.

This measure has the advantage that, once again, by particularly straightforward means which do not project to a great extent, the captive mounting, the displaceability and also the securability of the sliding block are made possible. Since corresponding shoulders are cut into the slots both of the sleeve carrier and of the holder, there is no need for any structural means which project laterally beyond these components. These shoulders constitute additional guides both for the screw and for the sliding block. In order to allow the displaceability, all that is required is for this screw to be released to some extent, the screw then moving, together with the sliding block, during displacement. Tightening the screw then brings about the additional securing action and the clamping between the sleeve carrier and the lateral holder.

In a further configuration of the invention, the sleeve carrier bears an arm bearing for an awning arm.

This measure, then, has the considerable advantage that the awning arm can thus extend in the respective plane of inclination of the sleeve since its inclination is automatically adjusted along therewith. This results in a particularly compact and narrow cassette awning.

In a further configuration of the invention, the lateral sleeve carrier and the lateral holder butt against one another via in each case one plate-like section, it being possible for these sections to be rotated relative to one another about the awning-canvas-shaft axis.

This measure has the advantage that the plate-like sections provide stable basic bodies which butt against one another over a relatively large surface-area section but can slide past one another with the result that it is possible to absorb laterally acting tilting forces as a result of the awning-canvas shaft being bent on account of the gravitational force or on account of the forces during the extending operation. As a result of the large-surface-area abutment, even relatively low clamping forces are sufficient in order to avoid these two elements rotating relative to one another as a result of gusts of wind when the awning is extended.

In a further configuration of the invention, the plate-like sections each have a central opening for accommodating a journal of the awning-canvas shaft.

This measure has the advantage that not just a centering action, but also the absorption of forces which are exerted by the awning-canvas-shaft journal can be distributed uniformly over the two elements.

In a further configuration of the invention, projecting from one of the plate-like sections is a neck which is accommodated in the other plate-like section.

This measure has the advantage not just that straightforward, centered installation is made possible, as a result of these two plate-like sections being plugged one inside the other, but also that the neck allows a correspondingly guided rotary movement during the inclination adjustment.

In a further configuration of the invention, the holder contains a plurality of radially oriented slot openings which are offset through approximately 90° in relation to one another in the circumferential direction.

This measure has the considerable advantage that one and the same holder can be used for installation both on a vertically upright wall and in the hanging state on a ceiling.

It goes without saying that the features which have been mentioned above and those which have yet to be explained hereinbelow can be used not just in a combination specified, but also in other combinations or alone, without departing from the scope of the present invention.

BRIEF DESCRIPTION OF THE DRAWINGS

The invention is explained and described in more detail hereinbelow, with reference to a selected exemplary embodiment in conjunction with the attached drawings, in which.

DETAILED DESCRIPTION OF THE PREFERRED EMBODIMENT

Figure 1:
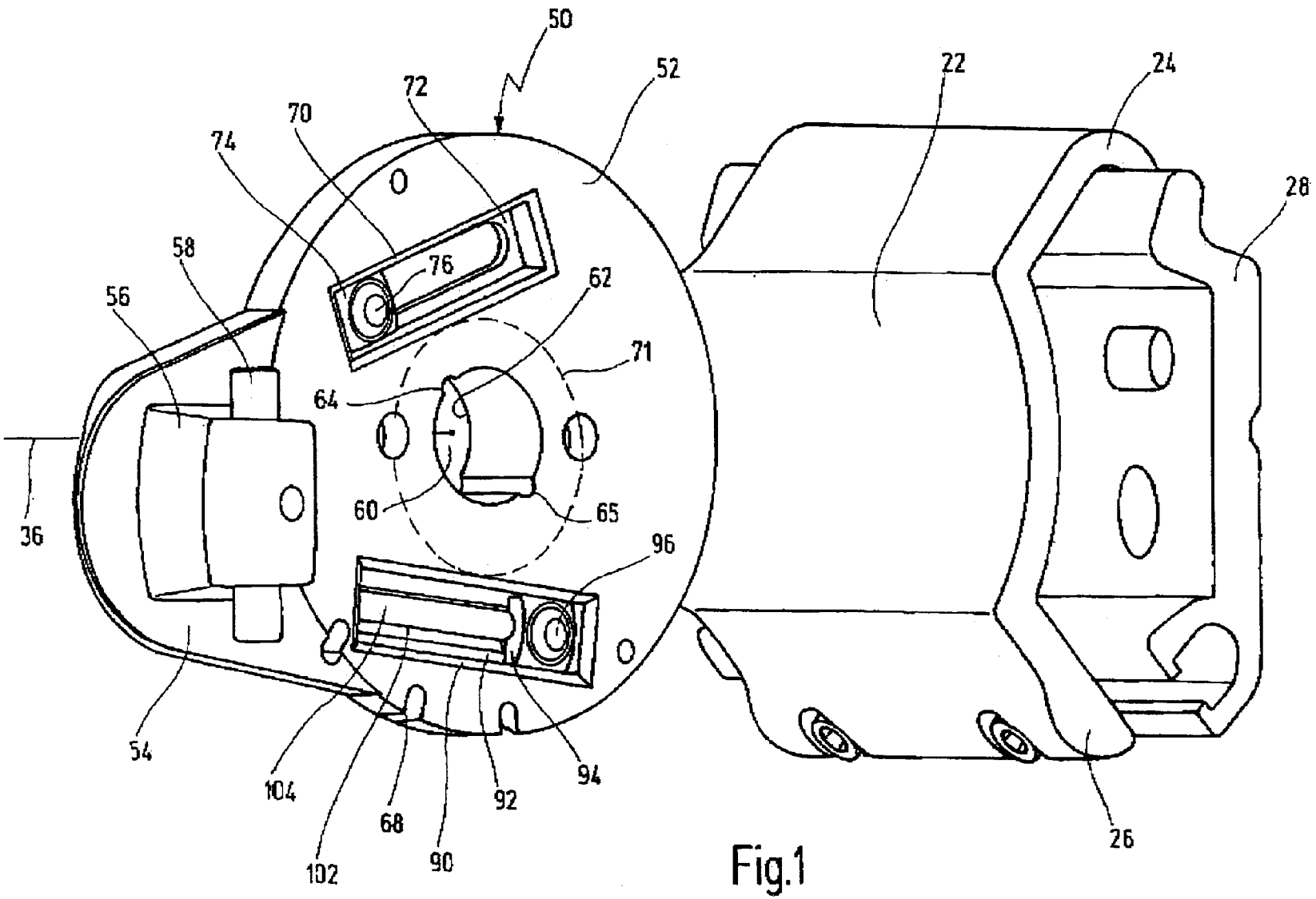
FIG. 1 shows a perspective view of a left-hand outer end of an awning as seen from inside.
Figure 2:
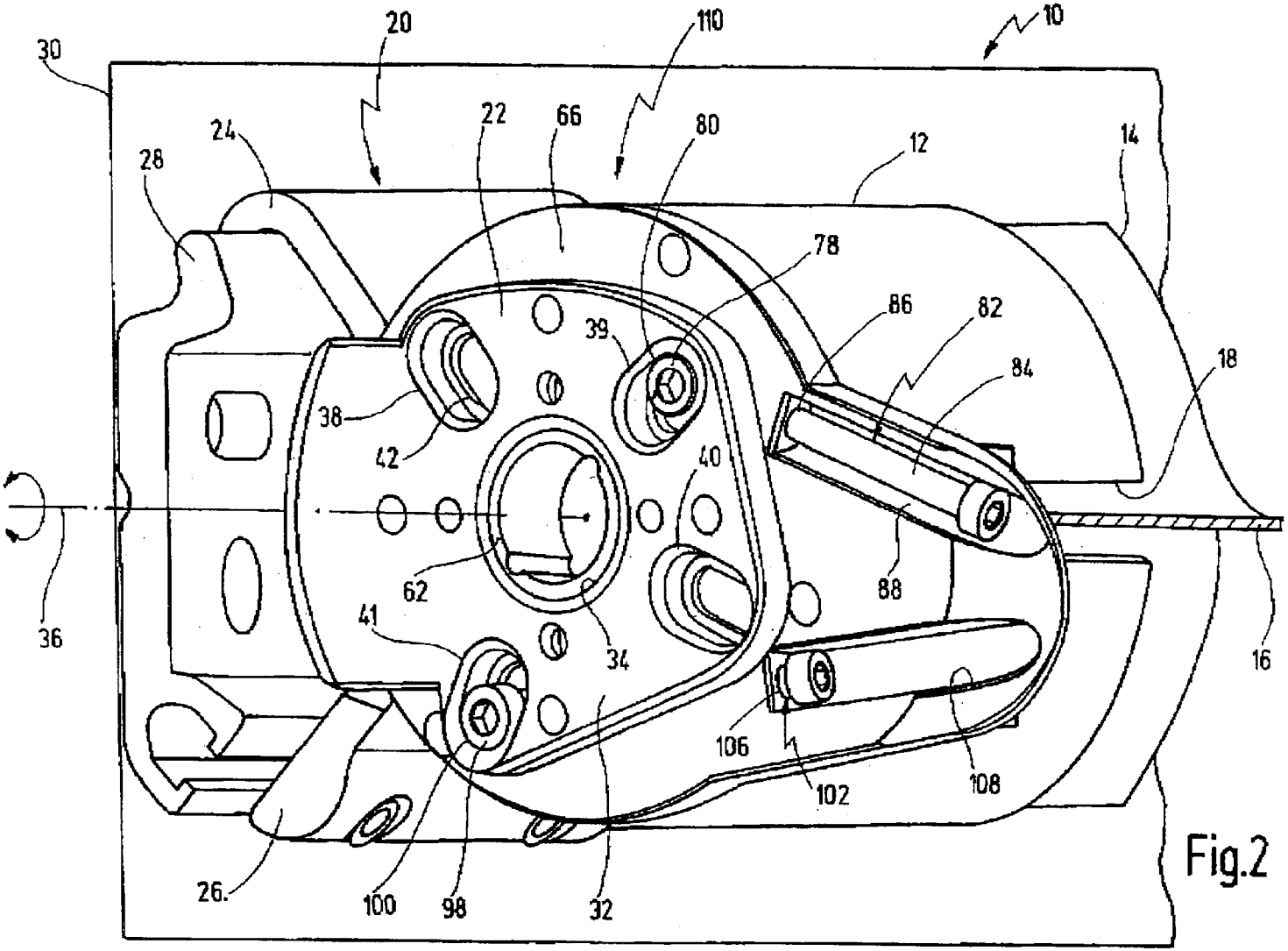
FIG. 2 shows a corresponding perspective view of this holder as seen from the left-hand outer end side, the sleeve and the awning-canvas shaft also being schematically indicated here in addition.

FIGS. 1 and 2 illustrate the left-hand outer end of an awning which is designated 10 overall.

The corresponding right-hand outer end (which is not illustrated here) is of mirror-inverted design.

As can be seen schematically from FIG. 2 in particular, the awning 10 has a sleeve 12 which encloses an awning-canvas shaft 14 on which an awning canvas 16 has been wound up.

The awning canvas 16 is guided out of the sleeve 12, and retracted into the latter again, through a slit-like opening 18.

For this purpose, as is known per se and need not be described any more specifically here, the opening-out end of the awning canvas 16 is provided with a corresponding opening-out rod, which ends up located in front of the slit-like opening 18 and via which the awning canvas 16 is drawn out. The opening-out rod is then connected to a corresponding mechanism, for example to a hinged arm which is known per se, which achieves the opening-out movement in conjunction with a drive mechanism.

The operations of retracting said awning canvas 16 and winding it up onto the awning-canvas shaft 14 are achieved in that the awning-canvas shaft 14 is rotated about the awning-canvas-shaft axis 36, that is to say, in the exemplary embodiment illustrated and in the view of FIG. 2, by rotation of the awning-canvas shaft 14 in the counterclockwise direction.

These mechanisms are sufficiently known to the person skilled in the art and thus need not be described in any more detail.

The awning 10 also has a support means 20.

This support means 20, as can be seen from FIG. 2 in particular, has a lateral holder 22 which, via two claws 24 and 26 projecting from it, is firmly connected to a retaining rail 28.

In the exemplary embodiment illustrated, the retaining rail 28 is fastened on a vertical wall 30, for example, the outside of a building, above a balcony which is to be provided with shade.

The lateral holder 22 has a plate-like section 32 which has a central opening 34 of which the center point is located along the awning-canvas-shaft axis 36.

In this embodiment, four radial slot openings 38, 39, 40 and 41 are provided in the plate-like section 32. The four radial slot openings 38 to 41 are offset, in this embodiment, through 90° in relation to one another in each case in the circumferential direction.

From the inside of each radial slot opening 38, 39, 40 and 41, a shoulder projects inward from the outside, that is to say as seen in the viewing direction of FIG. 2, only the shoulder 42 of the radial slot opening 38 being designated in this figure, but the other slot openings being provided with similar shoulders.

The support means 20 is assembled in a stationary, rigid and stable manner with the retaining rail 28.

A sleeve carrier 50 is arranged on the inside of the holder 22, as can also be seen, in particular, from FIG. 1.

The sleeve carrier 50 has a plate-like section 52 which is of approximately circular contour and, in the opening-out direction of the awning canvas, has a nose 54 which bears an arm bearing 56.

Illustrated in the arm bearing 56 is a pin 58, via which an arm, for example a hinged arm, can be fastened on the arm bearing 56. The arm (which is not illustrated here) can thus be pivoted about the longitudinal axis of the pin 58.

In the case of a hinged-arm-awning design, the outer opening-out end of the bottom arm of the hinged arm is connected to the abovementioned opening-out rod, which is fitted at the outer opening-out end of the awning canvas 16.

Provided in the plate-like section 52 of the sleeve carrier 50 is a central opening 60, which is encircled by a projecting neck 62 from the side which is directed toward the holder 22.

In the installed state, this neck 62 is fitted into the central opening 34 of the holder 22, as can be seen from FIG. 2 in particular. In this state, the outer circumferential side of the neck 62 butts in a closely fitting manner against the inner circumferential side of the central opening 34, with the result that the two plate-like sections 32 and 52 are centered about the central awning-canvas shaft axis or axis of rotation 36.

The plate-like section 52 of the sleeve carrier 50 is generally planar and, in this case, butts over the surface area against the corresponding inner side of the plate-like section 32 of the holder 22, as can likewise be seen from FIG. 2.

Provided in the inside of the neck 62 are two diametrically opposite axial grooves 64 and 65 which serve for accommodating, in a closely fitting manner, a correspondingly shaped laterally projecting journal (not illustrated here) of the awning-canvas shaft 14. The parts which butt against one another over their surface areas are located in a rotary plane 66. Also provided on the inside of the sleeve carrier 50 are drain openings 68, which allow any condensation which may have collected to flow out of the sleeve 12.

The sleeve 12, then, is installed on the inside of the sleeve carrier 50 such that it has its end-side annular surface located on the plate-like section 52 and it terminates the latter in an approximately flush manner in the circumferential direction, as can be seen from FIG. 2. Corresponding openings and screws serve for fastening the sleeve 12 in a predetermined position on the inside of the sleeve carrier 50.

As can be seen from FIG. 1 in particular, the sleeve carrier 50 contains an approximately tangential slot opening 70 which runs tangentially to an imaginary turning circle 71, which is indicated by dashed lines in FIG. 1.

As seen from the inside of the sleeve carrier 50, that is to say in the viewing direction of FIG. 1, a circumferentially running shoulder 72 projects inward from the inside of the slot opening 70.

A sliding block 74 rests on this shoulder 42 and in the slot opening 70.

The sliding block 74 is designed such that it can move back and forth along the tangential slot opening 70 but, on account of the shoulder 42, cannot pass axially from the inside to the outside through the slot opening 70.

An adjusting screw 76 is accommodated in sliding block 74, and its head 78 can be seen from FIG. 2.

The head 78 of the adjusting screw 76 here is accommodated in the radial slot opening 39 of the holder 22 and the underside of the head 78 rests on the corresponding shoulder 42 in this slot opening 39.

The adjusting screw 76 can be screwed into the sliding block 74 and unscrewed therefrom, in the axial direction, that is to say generally parallel to the awning-canvas-shaft axis 36.

This assembly in conjunction with the shoulders in the openings forms a securing arrangement 80.

This is because, if the adjusting screw 76 is screwed tight, the two plate-like sections 32 and 52 are drawn axially against one another and clamped to one another.

Provided for the purpose of displacing the sliding block 74 along the tangential slot opening 70 is an actuating element 82, which is designed as a screw 84 which runs in a thread 86 cut in the plate-like section 52 (see FIG. 2).

A corresponding fillet groove 88 is cut, from the outside, in the plate-like section 52, in particular in the region of the nose 54 thereof, and the actuating element 86 rests therein.

The end side of the screw 54 thus rests on that side of the approximately cuboidal sliding block 74 which is directed toward it.

As can be seen from FIGS. 1 and 2, a second tangential slot opening 90 is provided, this being located approximately diametrically opposite the first tangential slot opening 70, but being otherwise of the same design. That is to say, this slot opening 90 also has a shoulder 92, on which a sliding block 94 rests. This sliding block 94 is also provided with an adjusting screw 96, of which the head 98 is accommodated in the radial slot opening 41, as can be seen from FIG. 2 in particular. Here too, a securing arrangement 100 is provided by the interaction of the sliding block 94, the head 98 of the adjusting screw 96 and the shoulders 92 and 42.

The second tangential slot opening 90 is assigned an actuating element 102 in the form of a screw 104, which runs in a thread 106 cut in the body of the plate-like section 52. Here, too, a corresponding fillet groove 108 is provided on the outside of the sleeve carrier 50, and the screw 104 is accommodated therein.

The components in conjunction with the second tangential slot opening 90 constitute, overall, an arrangement 110 for adjusting the inclination of the sleeve 12.

The principle of the inclination adjustment will be described taking the relative position between the holder 22 and sleeve carrier 50 as is illustrated in FIGS. 1 and 2 as the departure point.

The relative position illustrated in FIGS. 1 and 2 is the angle of inclination 0°, that is to say the awning canvas 16 is extended approximately horizontally.

The sliding block 94 in the second tangential slot opening 90 is located in its extreme right-hand displacement position in the illustration of FIG. 1, and the screw 104 has been screwed in to the maximum extent and is supported on the sliding block 94.

The tilting moment of the arm accommodated by the arm bearing 56 forces the screw 104 onto the sliding block 94.

If the screw 104 is then unscrewed, the sleeve carrier 50 rotates in the counterclockwise direction, in the view of FIG. 1, about the awning-canvas-shaft axis 36, and the nose 54 is thus inclined downward.

Figure 3:
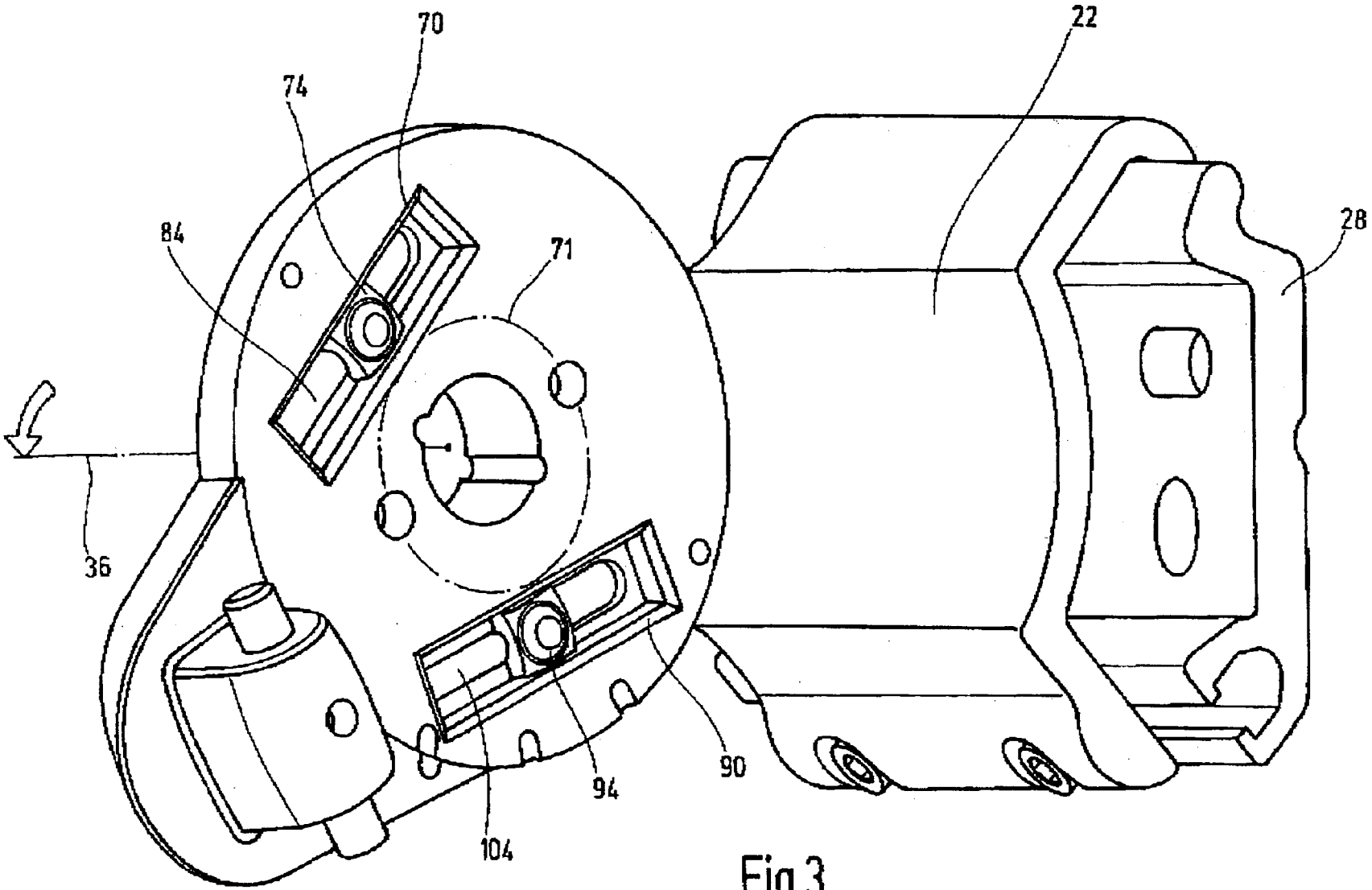
FIG. 3 shows a view, corresponding to FIG. 1, in a position which is inclined downward through approximately 30°.

In relative terms, the sliding block 94 slides to the left along the second tangential slot opening 90, as can be seen from the change between FIGS. 1 and 3.

At the same time, the sliding block 74 has been displaced correspondingly to the right from the extreme left-hand position in the slot opening 70, seen in FIG. 1.

In FIG. 3 and correspondingly in FIG. 4, the screw 84 is illustrated in the already adjusted state, but it is also possible for this to take place for the first time at a later point in time.

It can be seen from the change between FIGS. 1 and 3 that the radial spacing of the sliding block 94 from the axis of rotation 36 has changed to the effect that the radial spacing is smaller in the position of FIG. 3. In this case, the sliding block has advanced approximately tangentially toward the imaginary turning circle 71. The path difference or the radial relative movement is made possible in that the sliding block 94 has moved in the radial direction along the radial slot opening 41, as can be seen by the change in position between FIGS. 2 and 4. It has thus been able to move radially inward along this slot opening 41.

Figure 5:
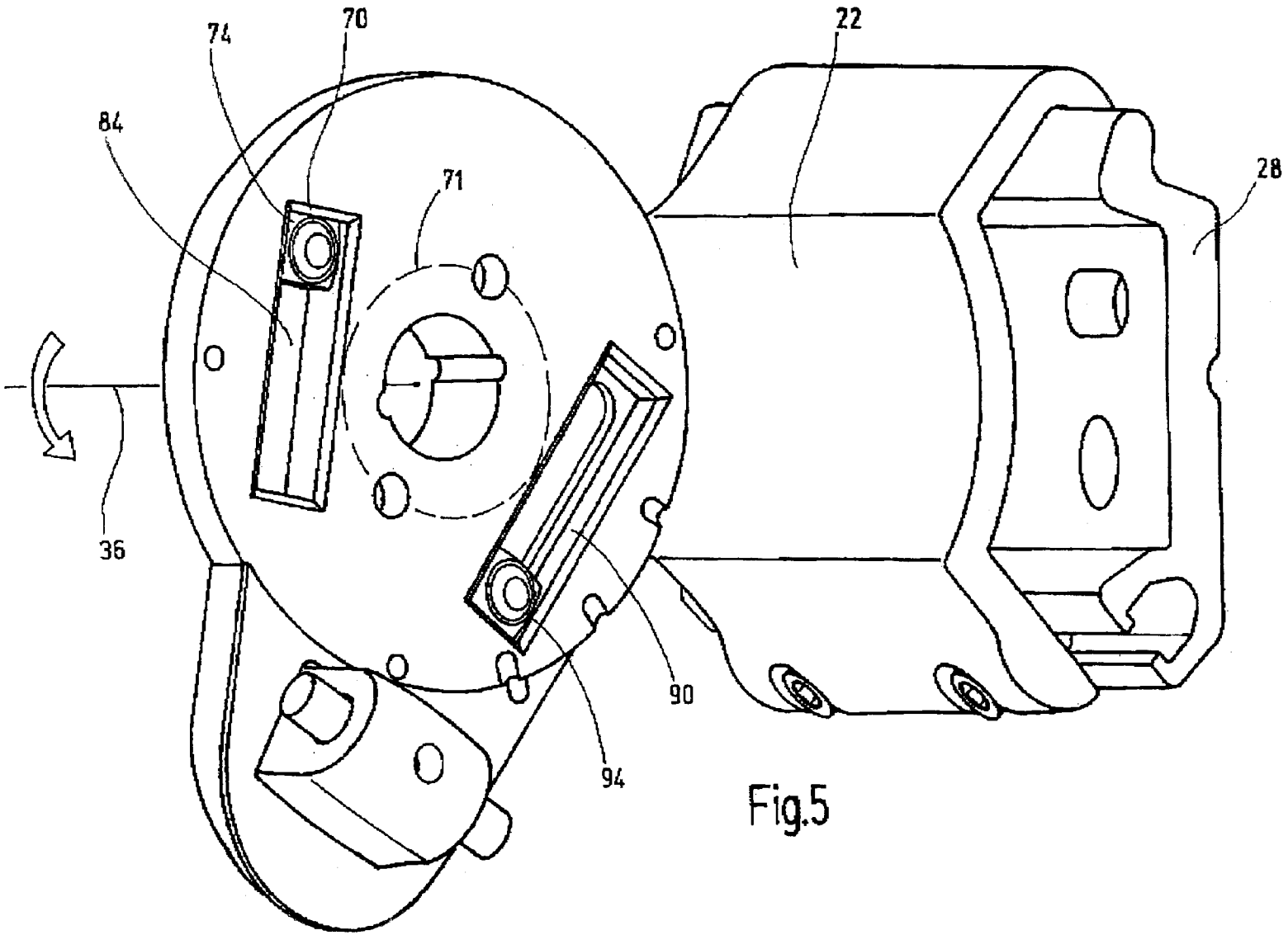
FIG. 5 shows an illustration, corresponding to the illustration of FIG. 1, in an inclined position of approximately 60° in the downward direction.

If the screw 104 is unscrewed yet further, then the sleeve carrier 50 is inclined yet further, as can be seen from the change between FIGS. 3 and 5, which corresponds to a change between an angle of inclination of approximately 30° and an angle of inclination of approximately 60°.

Figure 4:
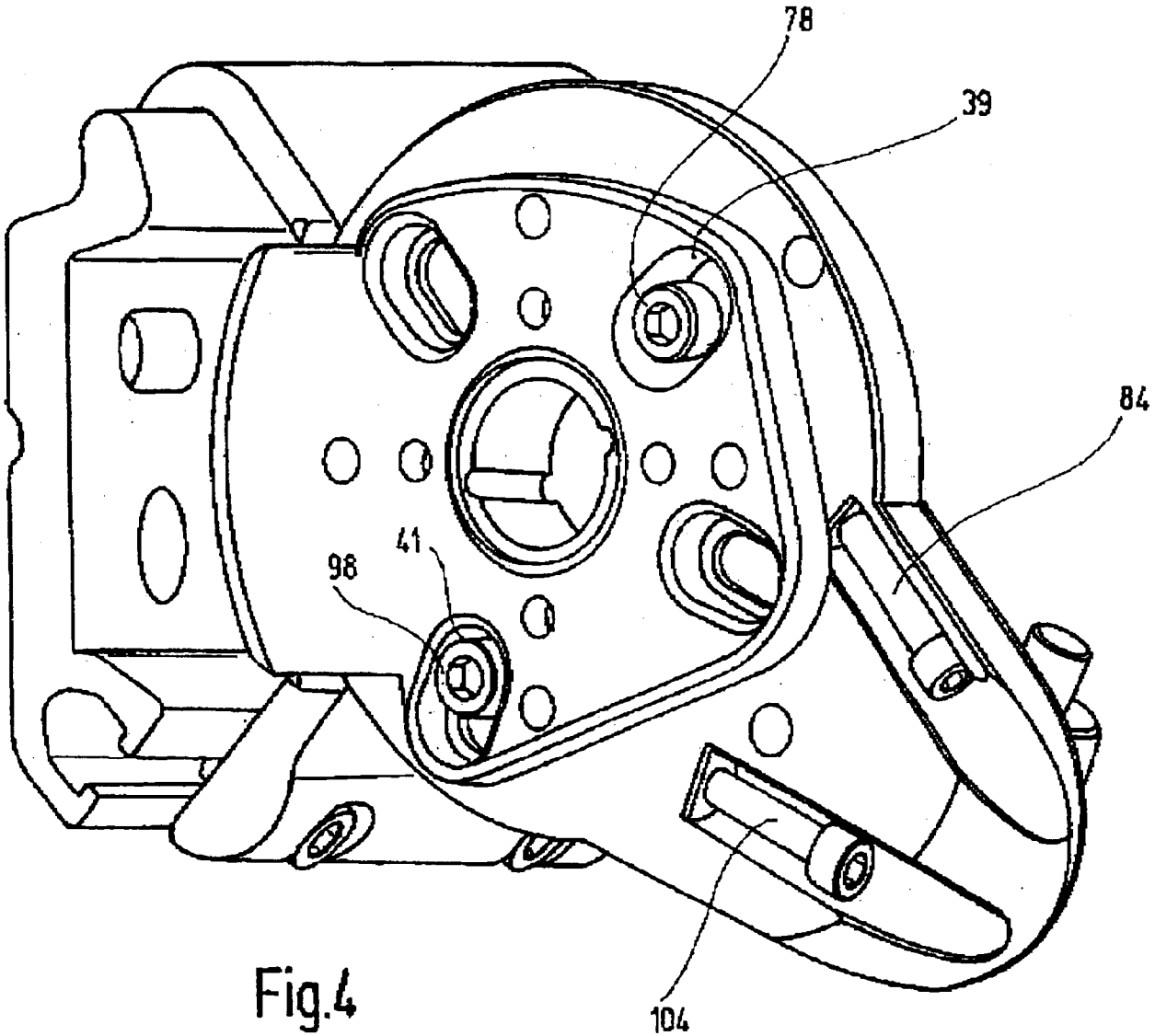
FIG. 4 shows an illustration, corresponding to FIG. 2, with an inclination through 30° in the downward direction.
Figure 6:
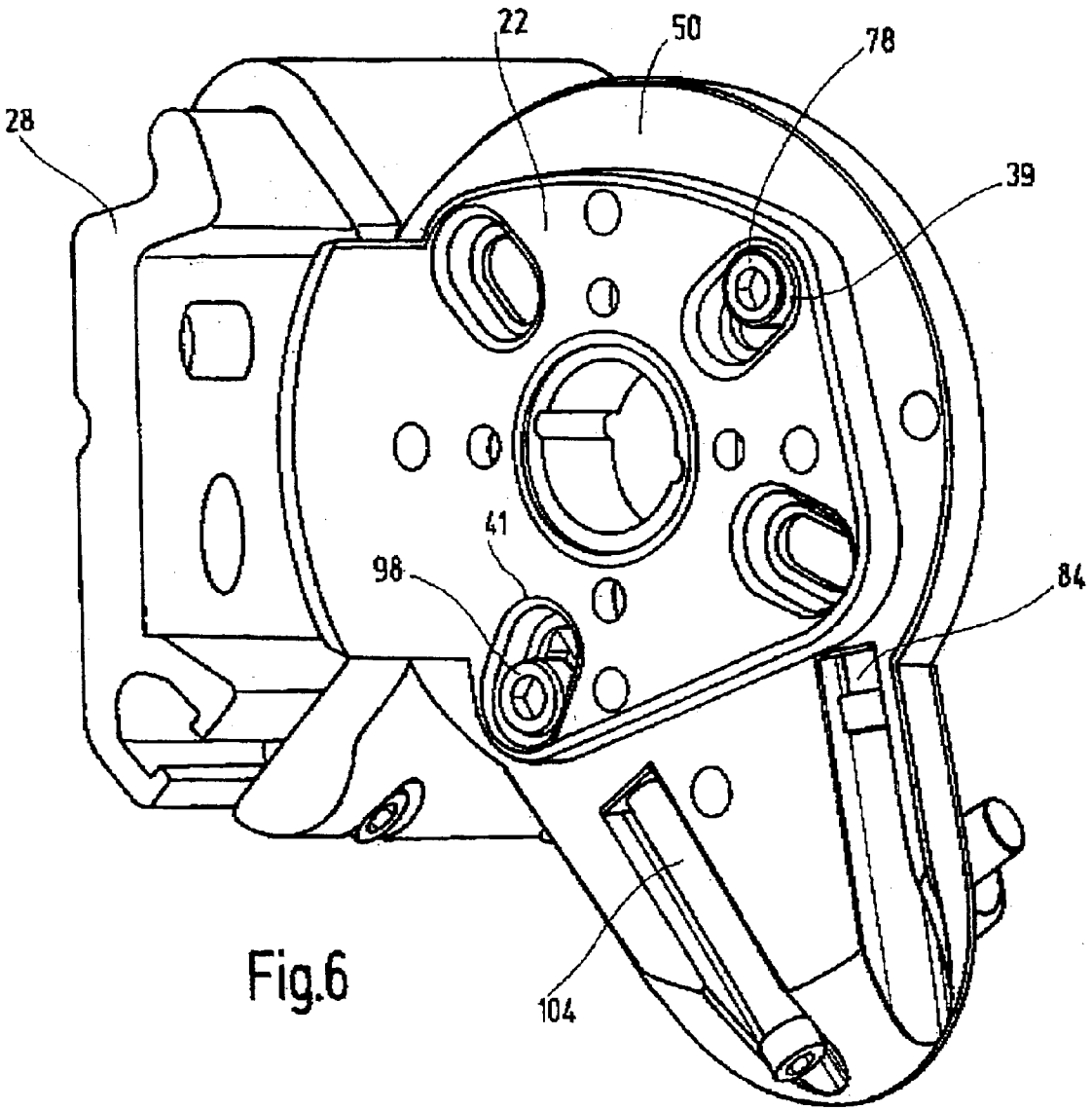
FIG. 6 shows a view, corresponding to FIG. 2, of the position which is inclined downward through 60°.

It can be seen from FIG. 5 that the radial spacing of the sliding block 94 from the awning-canvas-shaft axis 36 has increased again; accordingly, the head 98 of the adjusting screw 96 of the sliding block 94 has moved radially outward again in the change between FIGS. 4 and 6.

FIGS. 5 and 6 illustrate the maximum inclined position of the sleeve carrier 50, and thus of the sleeve 12, which, in the exemplary embodiment illustrated, is approximately 60° from the horizontal. It is also possible, however, to achieve an angle of inclination of up to 90° using a correspondingly longer design.

It can be seen from the illustration of FIG. 5 that the sliding block 94 has now arrived at the left-hand end of the slot opening 90.

If the inclination is to remain in this position, the screw 84 is screwed in until it butts against the sliding block 94. This inhibits the awning from blowing upward. In the case of the latter, which should correspond to a change between FIGS. 3 and 1, it would be necessary for the sliding block 74 to be able to move to the left in relative terms in the slot opening 70. This is blocked when the screw 84 has been screwed into the extent where it butts against the sliding block 74.

The respective adjusting screws 76 and 96 are then tightened.

If the inclination is to be reduced again from the position set in FIG. 5 or 6, the adjusting screws 76 and 96 are correspondingly released, the screw 104 is correspondingly screwed in, and the screw 84 is unscrewed.

In the exemplary embodiment illustrated, the awning 10 is installed such that the retaining rail 28 is installed on a vertical wall 30.

If the retaining rail 28 is installed on a ceiling, the awning canvas would then extend vertically from the position illustrated in FIGS. 1 and 2 and could then be "inclined" inward if need be.

If a corresponding inclination in the outward direction from the vertical should then be desired, the sleeve carrier 50 is fitted on the holder 22 in a manner offset through 90°, that is to say, rather than being inserted into the radial slot openings 39 and 41 as is shown, for example, in FIG. 2, it is inserted into the slot openings 38 and 40 which are offset through 90° in relation thereto.

What is claimed is:

1. An awning comprising:

a canvas shaft defining a shaft axis, a canvas wound onto the canvas shaft, a sleeve enclosing the canvas shaft, the sleeve having a slit-like opening, wherein the canvas can be retracted and extended through the slit-like opening, opposed lateral holders comprising plate-like sections each defining at least one generally radially extending slot opening respective sleeve carriers to which opposed ends of the sleeve are attached and which are connected to the respective lateral holder and can be rotated relative to the holders about the canvas-shaft axis wherein the sleeve carriers comprise at least a first slot opening extending generally in a tangential direction in relation to an imaginary turning circle, a sliding block running within each of the tangential slot openings, first actuating elements, wherein the first actuating elements are engaged with the sleeve carrier and the sliding block; and adjusting screws engaged with each sliding block wherein the adjusting screws extends into respective radial slot openings such that actuation of the actuating elements induce rotation of the sleeve carriers and sleeve with respect to the lateral holders generally about the shaft axis.

2. The awning of claim 1, further comprising respective second tangential slots, sliding blocks, actuating elements, and adjusting screws arranged generally diametrically opposite the first tangential slots, sliding blocks, actuating elements, and adjusting screws with respect to the awning-canvas-shaft axis and wherein the second sliding blocks run in generally opposite directions to the first sliding blocks.

3. The awning of claim 1, wherein the actuating elements comprises a screw which runs in a thread formed in the sleeve carrier.

4. The awning of claim 1, wherein the sliding blocks and adjusting screws together define securing arrangements via which the sleeve carrier and the lateral holder can be clamped to one another.

5. The awning of claim 1, wherein a head of the adjusting screw and the sliding block each rest on shoulders in the radial and tangential slots respectively.

6. The awning of claim 1, wherein the sleeve carrier further comprises an arm bearing for an awning arm.

7. The awning of claim 1, wherein the respective sleeve carriers and lateral holders each comprise plate sections arranged so as to abut each other.

8. The awning of claim 7, wherein the plate sections each have a central opening for accommodating a journal of the awning-canvas shaft.

9. The awning of claim 8, wherein projecting from one of the plate sections is a neck which is accommodated in the other plate section.

10. The awning of claim 1, wherein the lateral holders comprises third and fourth generally radially oriented slot openings which are offset through 90° in relation to one another and the first and second generally radially extending slots in a circumferential direction.

11. An apparatus for adjusting an angular inclination of an awning sleeve about an awning shaft axis, the apparatus comprising:

at least one lateral holder configured for attachment to at least one of a generally vertically and a generally horizontally arranged surfaces and the at least one lateral holder defining at least a first generally radially extending slot;

at least one sleeve carrier rotatably engaged with the at least one lateral holder and attached to a first end of the awning sleeve and defining at least a first generally tangentially extending slot;

at least one sliding block supported within the at least first generally tangential slot;

at least one adjusting screw engaged with the at least one sliding block such that a head of the adjusting screw is also supported within the at least first generally radial slot; and at least one actuating element engaged with the sliding block and at least one of the lateral holder and the sleeve carrier such that actuation of the at least one actuating element induces the sleeve carrier to rotate with respect to the lateral holder so as to adjust the angular inclination of the awning sleeve between a generally horizontal and a generally downward orientation.

12. The apparatus of claim 11, wherein actuation of the at least one actuating element induces substantially rectilinear movement of the at least one sliding block within the at least first generally tangential slot and of the at least one adjusting screw within the at least first generally radial slot such that the at least one sliding block and adjusting screw are positioned at varying radial distances from the awning shaft axis.

13. The apparatus of claim 11, comprising a plurality of generally radially extending slots and a corresponding plurality of generally tangentially extending slots arranged such that the at least one sliding block, adjustment screw, and actuating element can be positioned in appropriate slots such that the apparatus can be attached to either of the generally vertically or generally horizontally arranged surfaces and can adjust the angular inclination of the awning sleeve between a generally horizontal and a generally downward orientation.

14. The apparatus of claim 11, comprising at least second generally radially extending slots and corresponding at least second generally tangentially extending slots arranged such that a second sliding block, second adjustment screw, and second actuating element can be positioned in appropriate slots such that the apparatus resists rotation of the awning sleeve from the adjusted inclination in either rotational direction about the awning shaft axis.

* * * * *

UNITED STATES PATENT AND TRADEMARK OFFICE

CERTIFICATE OF CORRECTION

PATENT NO. : 6,874,558 B2
DATED : April 5, 2005
INVENTOR(S) : Mester et al.

It is certified that error appears in the above-identified patent and that said Letters Patent is hereby corrected as shown below:

Column 10,
Line 15, delete “directions” and insert -- direction --.
Line 17, delete “comprises” and insert -- comprise --.

Signed and Sealed this

Fourth Day of October, 2005

JON W. DUDAS
*Director of the United States Patent and Trademark Office*